US007930842B2

(12) United States Patent
Tatsuno

(10) Patent No.: US 7,930,842 B2
(45) Date of Patent: Apr. 26, 2011

(54) SNOWSHOES WITH CRAMPONS

(75) Inventor: Isamu Tatsuno, Osaka (JP)

(73) Assignee: Mont-Bell Co., Ltd., Osaka (JP)

( * ) Notice: Subject to any disclaimer, the term of this patent is extended or adjusted under 35 U.S.C. 154(b) by 772 days.

(21) Appl. No.: 12/007,816

(22) Filed: Jan. 15, 2008

(65) Prior Publication Data

US 2008/0172908 A1 Jul. 24, 2008

(30) Foreign Application Priority Data

Jan. 15, 2007 (JP) ..... 2007-005875

(51) Int. Cl.
*A43B 5/04* (2006.01)

(52) U.S. Cl. ..... 36/124; 36/125

(58) Field of Classification Search ..... 36/122–125
See application file for complete search history.

(56) References Cited

U.S. PATENT DOCUMENTS

| | | | | |
|---|---|---|---|---|
| 3,344,538 | A * | 10/1967 | Massicotte | 36/125 |
| 3,599,352 | A * | 8/1971 | Novak et al. | 36/123 |
| 4,203,236 | A * | 5/1980 | Erickson et al. | 36/123 |
| 4,348,823 | A * | 9/1982 | Knapp et al. | 36/123 |
| 6,105,281 | A * | 8/2000 | Wing et al. | 36/122 |
| 6,564,478 | B1 * | 5/2003 | Wing et al. | 36/122 |
| 2008/0134544 | A1 * | 6/2008 | Kreutzer et al. | 36/123 |

FOREIGN PATENT DOCUMENTS

| | | |
|---|---|---|
| JP | 2002-125712 | 5/2002 |
| JP | 2003-125808 | 5/2003 |

* cited by examiner

*Primary Examiner* — Ted Kavanaugh
(74) *Attorney, Agent, or Firm* — Morgan, Lewis & Bockius LLP

(57) ABSTRACT

Provided is a snowshoe with crampons, whose portion equipped with the crampons can be removed from a snowshoe body, and that is compactly portable. A snowshoe with crampons 1 includes: a snowshoe body 10 having a larger area than that of the bottom of the footgear and including an opening 11 located in a toe-side area of the footgear when the footgear is attached to the snowshoe with crampons 1; and an attachable member 50 located in the opening 11 and placed in the snowshoe body 10 so that it can be attached to or detached from the snowshoe body 10 whenever necessary; wherein the attachable member 50 has, on its one surface opposite the other surface to which the footgear is to be attached, crampons protruding in directions generally toward the ground and first engaging members 25A, 25B for engaging with the snowshoe body 10 in such a manner that they can rotate and be attached to or detached from the snowshoe body 10; and when the attachable member 50 has been rotated a specified angle, the first engaging members 25A, 25B release the engagement with the snowshoe body 10 and remove the attachable member 50 from the snowshoe body 10.

7 Claims, 14 Drawing Sheets

(A)

(B)

SNOWSHOES WITH CRAMPONS

CROSS-REFERENCES TO RELATED APPLICATIONS

This application relates to and claims priority from Japanese Patent Application No. 2007-5875, filed on Jan. 15, 2007, the entire disclosure of which is incorporated herein by reference.

BACKGROUND

1. Field of the Invention

The invention relates to snowshoes with crampons that are attached to footwear such as shoes and used when walking on snowy ground such as in deep snow areas in winter mountains.

2. Description of Related Art

Tools called "kanjiki ('snowshoes' in Japanese)" have been conventionally used by a wearer to walk and move on snowy ground, for example, in deep snow areas in winter mountains. These kanjiki are a walking tool for making it easier for a wearer to walk on the snowy ground by distributing the weight of the wearer over the deep snowy ground and obtaining buoyancy over the snow, thereby reducing sinking into the snow. However, in actual snow mountains, there is not only the deep snowy ground, but also frozen slopes. In order to walk on such frozen surfaces, it is necessary to change the kanjiki to climbing irons. Consequently, it is in fact necessary to carry around both the kanjiki and the climbing irons, which is an annoying increased burden to carry.

Therefore, in recent years, tools called "snowshoes" (western kanjiki) are being used to make it easier for a wearer to walk on the snowy surface than it is with the kanjiki. In some cases, the snowshoe has non-slip claws (crampons) on its surface facing the snowy surface when a wearer wears it (hereinafter referred to as the "underside"). When the wearer passes a partly frozen place, he does not have to change his snowshoes to, for example, climbing irons and can continue walking with the snowshoes attached to his shoes.

As an example of such a tool (snowshoe), there is a snowshoe including: a body to be attached to a shoe when a wearer walks on a snowy surface; a first crampon protruding from the snow-surface side of the body and placed at a position corresponding to a toe portion of the shoe; a second crampon protruding from the snow-surface side of the body and placed at a position corresponding to a heel portion of the shoe; and a plurality of third crampons respectively protruding from the snow-surface side of both side edges of the body and having larger claws than those of the first and second crampons. (See, for example, Japanese Patent Application Laid-Open (Kokai) Publication No. 2002-125712).

There is another type of tool (snowshoe) that has a larger area than that of the bottom of a shoe, and includes: a frame made of a single metal plate; a fastening means for fastening the shoe to the upper side of the frame; and non-slip claws protruding downwards from the underside of the frame. (See, for example, Japanese Patent Application Laid-Open (Kokai) Publication No. 2003-125808).

However, conventional snowshoes with crampons are structured to be bulky as a whole because the crampons are fixed to the underside of the snowshoe, and straps and the like for fastening a shoe to the snowshoe with crampons are placed on one surface of the snowshoe opposite the underside (hereinafter referred to as the "upper side"). As a result, they are inconvenient to carry around and it is also difficult to carry or store the pair of snowshoes with crampons by putting either one of the left-foot snowshoe and the right-foot snowshoe on top of the other to make them in compact size.

Under circumstances where steep slopes or similar are frozen, the body (or deck) of a conventional snowshoe with crampons becomes a factor with regard to slippage. Therefore, it is common to walk with only the climbing irons (or crampons), without putting the snowshoes on. However, with conventional snowshoe with crampons, the crampons are fixed to the underside of the snowshoe and thereby cannot be separated from the body (or deck). As a result, it is necessary to separately carry the climbing irons in addition to the snowshoe with crampons, which is cumbersome.

SUMMARY

The present invention was devised in light of the circumstances described above. It is an object of the invention to provide a snowshoe with crampons, that can be carried and stored in compact size, with the portion equipped with the crampons able to be removed from the snowshoe body, and the removed portion described above able to be used independently as climbing irons.

In order to achieve the above-described object, a snowshoe with crampons for preventing footgear from sinking in snow is provided. This snowshoe with crampons includes: a snowshoe body having a larger area than that of the bottom of the footgear and including an opening located in a toe-side area of the footgear when the footgear is attached to the snowshoe with crampons; and an attachable member located in the opening in the snowshoe body and placed in the snowshoe body so that it can be attached to or detached from the snowshoe body whenever necessary; wherein the attachable member has, on its one surface opposite the other surface to which the footgear is to be attached, crampons protruding in directions generally toward the ground and first engaging members for engaging with the snowshoe body in such a manner that they can rotate and be attached to or detached from the snowshoe body; and when the attachable member has been rotated a specified angle, the first engaging members release the engagement with the snowshoe body and release the attachable member from the snowshoe body.

Since with the snowshoe with crampons having the above-described configuration, the attachable member equipped with the crampons, which are the factor causing bulkiness, can be removed from the snowshoe body, the snowshoe body can be carried around or stored compactly without the problem of bulkiness. As a result, when carrying around the snowshoes with crampons, even if the right-foot snowshoe body and the left-foot snowshoe body are put one over the other, they can be carried around or stored compactly without the problem of bulkiness. Also, the weight of the snowshoe with crampons can be distributed by separating the snowshoe body from the attachable member. Therefore, if a person glides (for example, skis) over the snow while carrying the snowshoe with crampons, the heavier attachable member can be placed close to the wear's body and the lighter snowshoe body can be mounted on the outside of a knapsack or similar, so that it is possible to prevent, for example, the influence of centrifugal force and enhance the sense of stability when gliding. Also, removed attachable members can be used independently as climbing irons. As a result, it is unnecessary to separately carry climbing irons in addition to the snowshoes with crampons, which is convenient. Incidentally, both the right-foot and left-foot snowshoes with crampons may be of the same shape or a bilaterally-symmetric shape; and there is no particular limitation with regard to this point.

Also, the snowshoe with crampons according to an aspect of this invention can be configured so that the snowshoe body has a spindle extending in a generally-horizontal direction relative to a widthwise direction of the snowshoe body and being placed across the opening and supports the attachable member so that the attachable member can rotate around the spindle; and the spindle includes second engaging members for engaging with the first engaging members so that the first engaging members can rotate around the second engaging members and be attached to or detached from the second engaging members. With the snowshoe with crampons having the above-described configuration, the attachable member can rotate around the spindle as a fulcrum point, clockwise or counterclockwise as seen with the toe side of the snowshoe body on the left. With the snowshoe with crampons according to this aspect of the invention, the opening in which the attachable member is located is formed in an area where the toe side of footgear will be positioned when the footgear is attached to the snowshoe with crampons. Therefore, the heel side of the footgear will be positioned on the rear side closer to the rear end of the snowshoe body than the opening. As a result, in addition to the advantageous effects mentioned above, when the footgear is attached to the snowshoe with crampons, the wearer can walk stably without letting the attachable member rotate clockwise (as seen with the toe side of the snowshoe body on the left) more than necessary (i.e., without letting the attachable member rotate to allow the heel side of the attachable member to move closer to the ground more than necessary.

Moreover, with the snowshoe with crampons according to an aspect of this invention, a stopper for preventing the attachable member from rotating more than the specified angle counterclockwise as seen with the toe side of the snowshoe body on the left can be placed on the snowshoe body. Because of this configuration, in addition to the advantageous effects mentioned above, when the footgear is attached to the snowshoe with crampons, the wearer can walk more stably without letting the attachable member rotate counterclockwise (as seen with the toe side of the snowshoe body on the left) more than necessary (i.e., without letting the attachable member rotate to allow the toe side of the attachable member to move closer to the ground more than necessary. It is also possible to prevent the attachable member from rotating too much and the top end of the attachable member from hitting the wear's shin.

Furthermore, the snowshoe with crampons according to an aspect of this invention can be configured so that when the attachable member has been rotated a specified angle clockwise as seen with the toe side of the snowshoe body on the left, the engagement between the first engaging members and the second engaging members can be released. Because of this configuration, when the footgear is attached to the snowshoe with crampons, in addition to the aforementioned advantageous effects, the attachable member will not be removed from the snowshoe body and it is possible to prevent the attachable member from suddenly coming off the snowshoe body. Also, the snowshoe with crampons having the above-described configuration can also be configured so that each of the first engaging members has a support hole for supporting the spindle so that it can rotate, and a cut formed as a passage to the support hole; and each of the second engaging members is of a generally-oval cross-sectional shape as taken generally perpendicular to its axial direction, and a minor axis of the generally-oval shape is shorter than a minimum value of the distance between the second engaging member and a side wall of the first engaging member defining the cut; and wherein when the attachable member has been rotated a specified angle clockwise as seen with the toe side of the snowshoe body on the left, the minor axis of the generally-oval shape is positioned in generally parallel with the side wall surface defining the cut, and each of the second engaging members is removed through the cut from the support hole, thereby releasing the engagement.

The snowshoe with crampons according to an aspect of this invention can also be configured so that a fastening member for fastening the footgear to the snowshoe with crampons is placed on one surface of the attachable member where the footgear is to be attached. Because of this configuration, when the attachable member is removed from the snowshoe body, the fastening member for fastening the footgear will also be removed together with the attachable member. Therefore, the right-foot snowshoe body and the left-foot snowshoe body can be carried around or stored compactly without the problem of bulkiness. Also, attachable members removed from a snowshoe body can be used independently as climbing irons.

Furthermore, the first engaging members can be formed as crampons protruding in directions generally toward the ground from one surface of the attachable member opposite the other surface where the footgear is to be attached.

Since with the snowshoe with crampons according to an aspect of the invention, the attachable member equipped with the crampons can be removed from the snowshoe body, the snowshoe body can be carried around or stored compactly without the problem of bulkiness. As a result, if a person glides (for example, skis) while carrying the right-foot snowshoe body and the left-foot snowshoe body placed one over the other, it is easier for the person to glide without being bothered by bulky baggage. Also, the weight of the snowshoe with crampons can be distributed by removing the attachable member from the snowshoe body. Therefore, when a person glides (for example, skis) while carrying the snowshoes with crampons, it is possible to prevent, for example, the influence of centrifugal force and enhance the sense of stability when gliding. Also, removed attachable members can be used independently as climbing irons. As a result, it is unnecessary to separately carry the climbing irons in addition to the snowshoes with crampons, which is convenient.

DETAILED DESCRIPTION OF PREFERRED EMBODIMENTS

A snowshoe with crampons according to a preferred embodiment of the invention will be described below with reference to the attached drawings. The embodiment described below is for the purpose of describing this invention, but the invention is not limited only to this embodiment. Accordingly, this invention can be utilized in various ways unless those utilizations depart from the gist of the invention.

Incidentally, a snowshoe with crampons is attached to both the right and left feet of a user and, therefore, two snowshoes with crampons constitute a pair. However, the configuration of one snowshoe with crampons will be taken as an example and explained in this embodiment.

Figure 1:
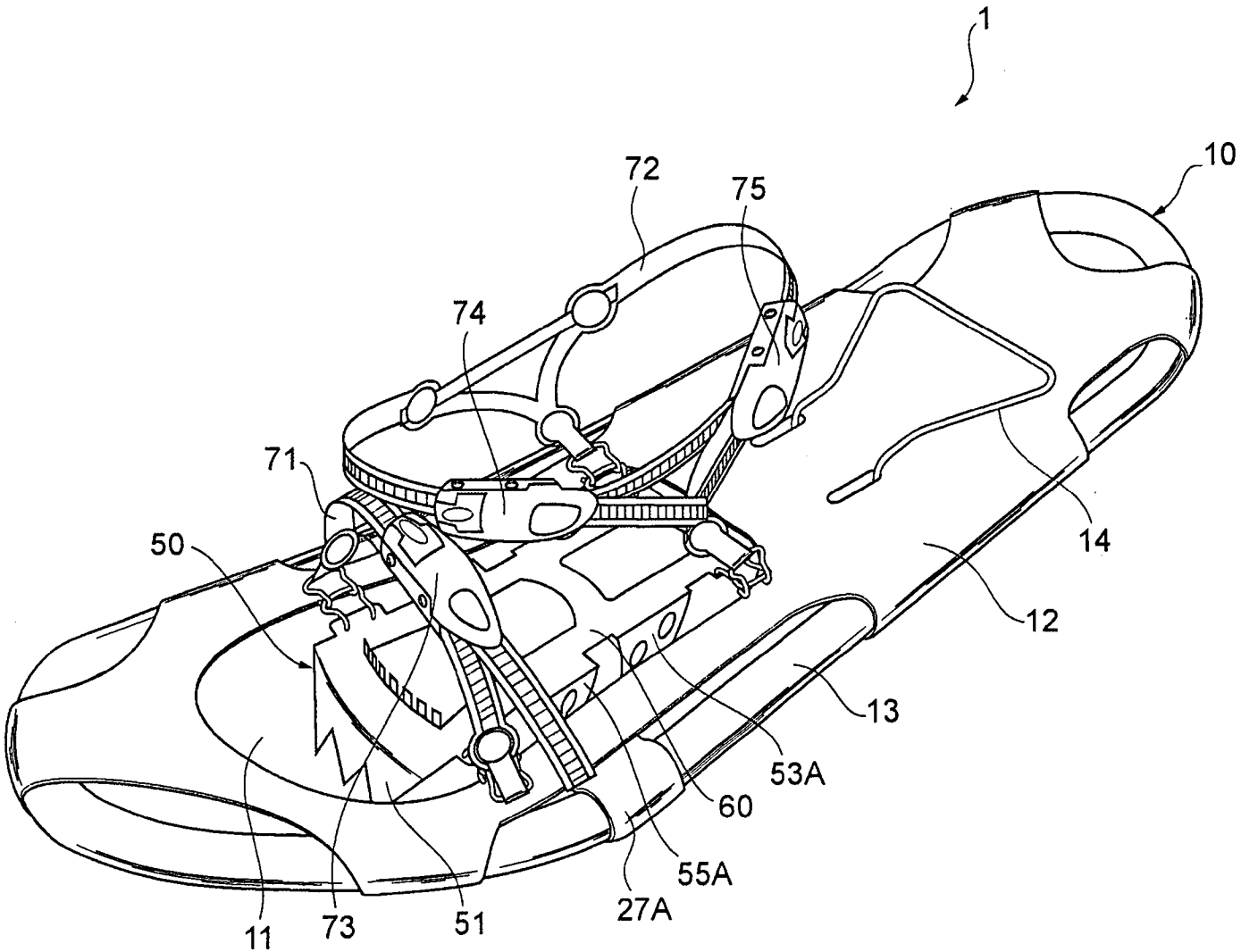
FIG. 1 is a perspective view of a snowshoe with crampons according to an embodiment of the present invention.
Figure 2:
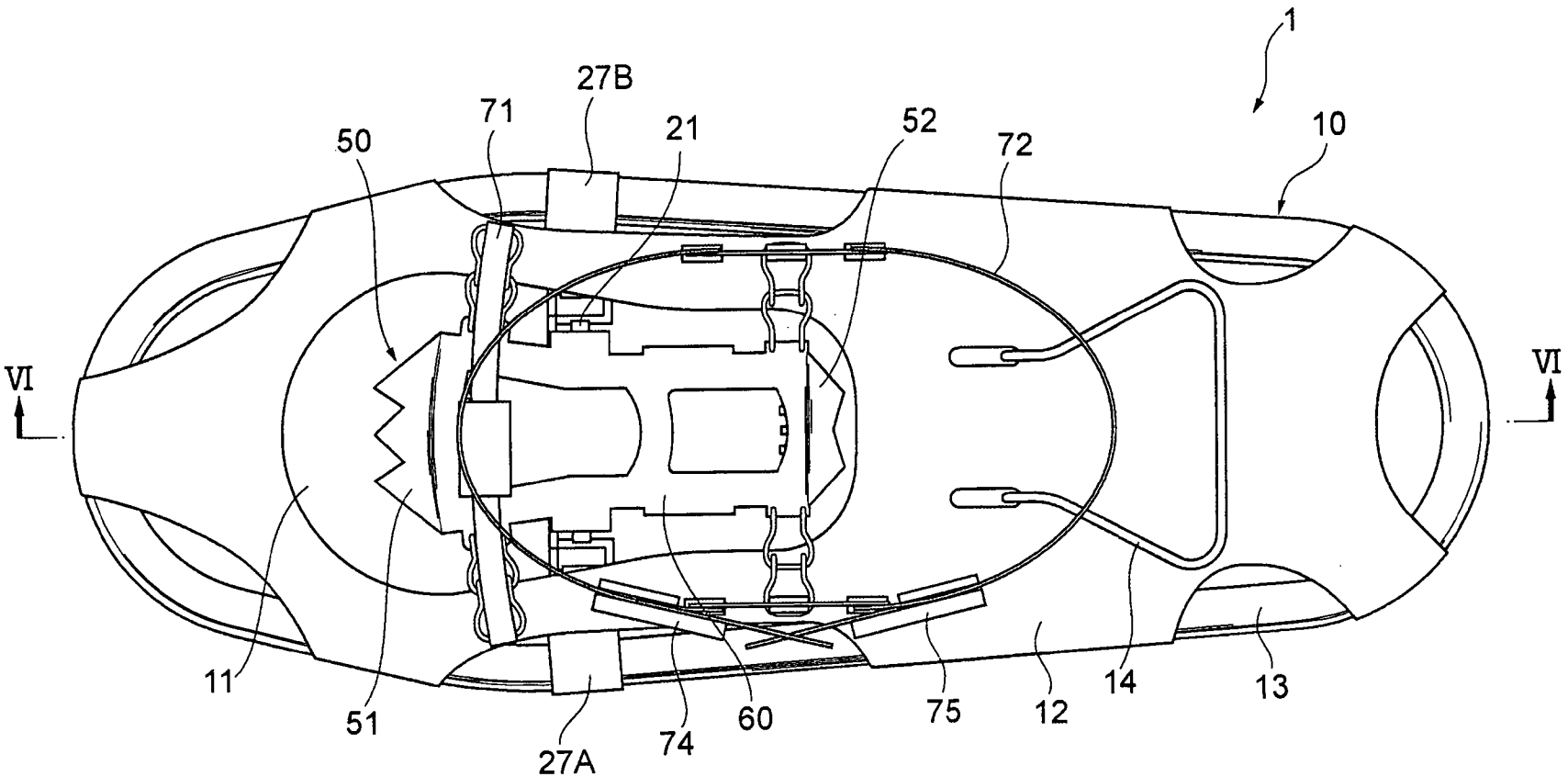
FIG. 2 is a plan view of the snowshoe with crampons according to the embodiment of this invention.
Figure 3:
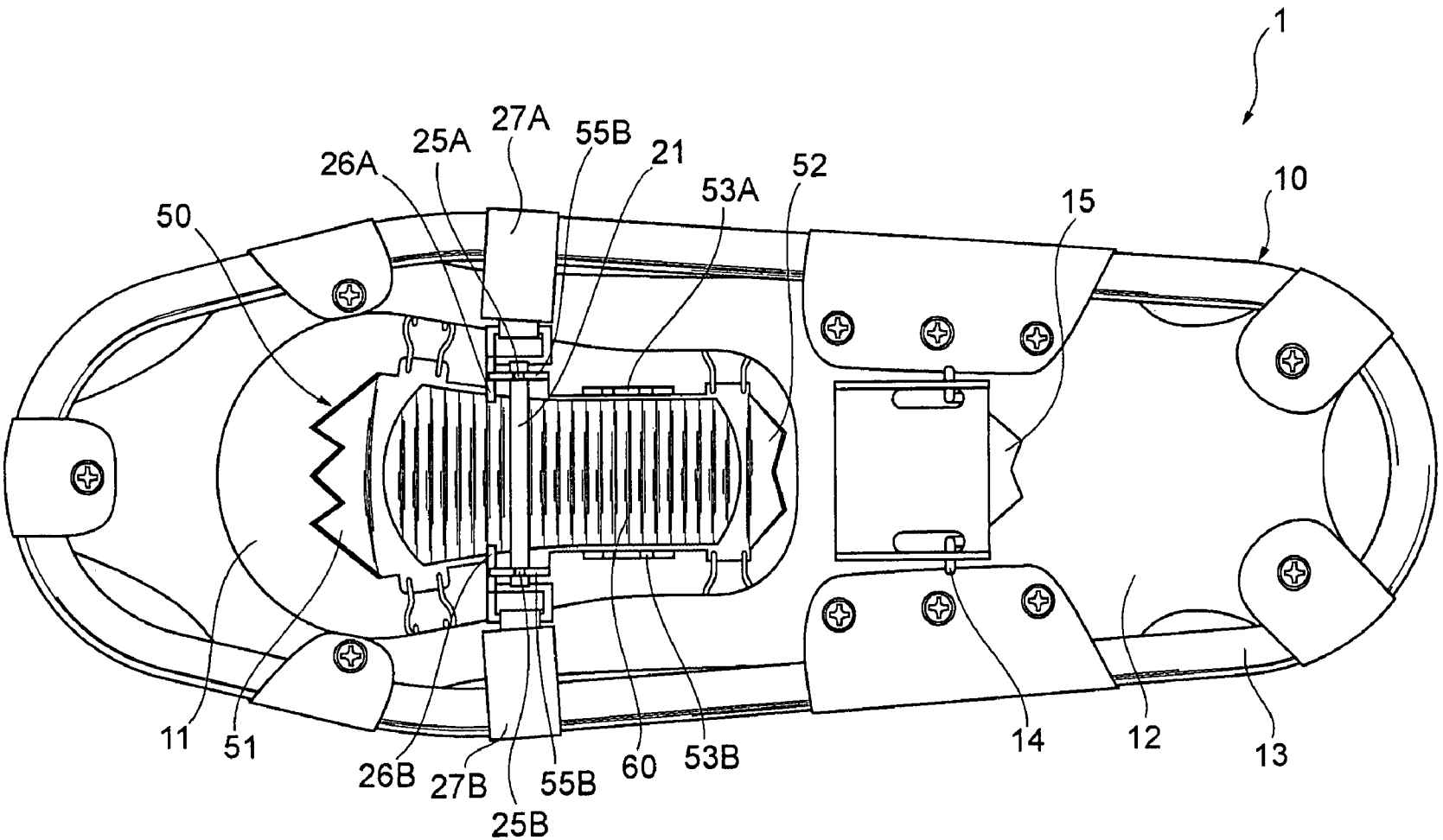
FIG. 3 is a bottom view of the snowshoe with crampons according to the embodiment of this invention.
Figure 4:
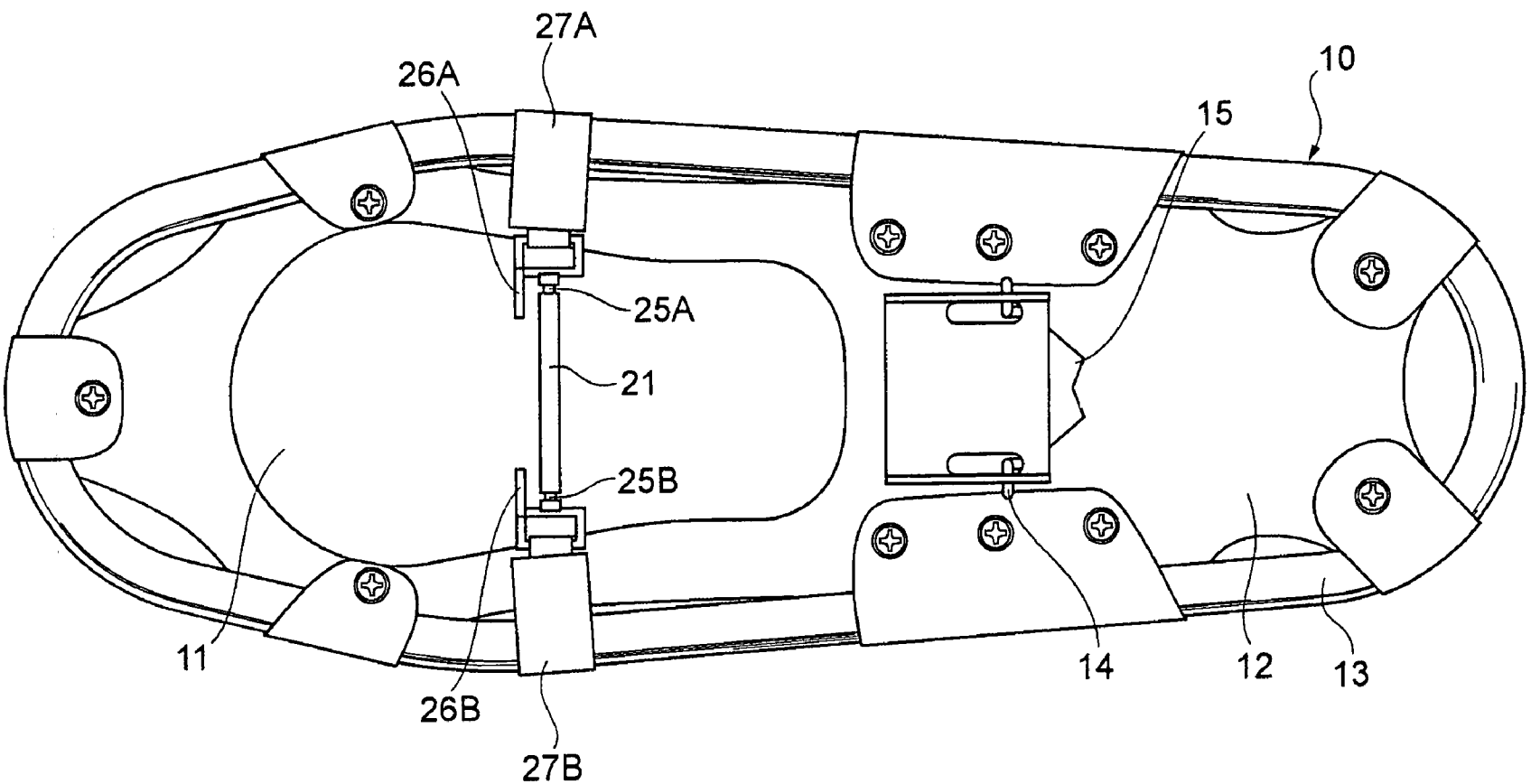
FIG. 4 is a bottom view of the snowshoe with crampons according to the embodiment of this invention and shows the state where an attachable member is removed from a snowshoe body.
Figure 5:
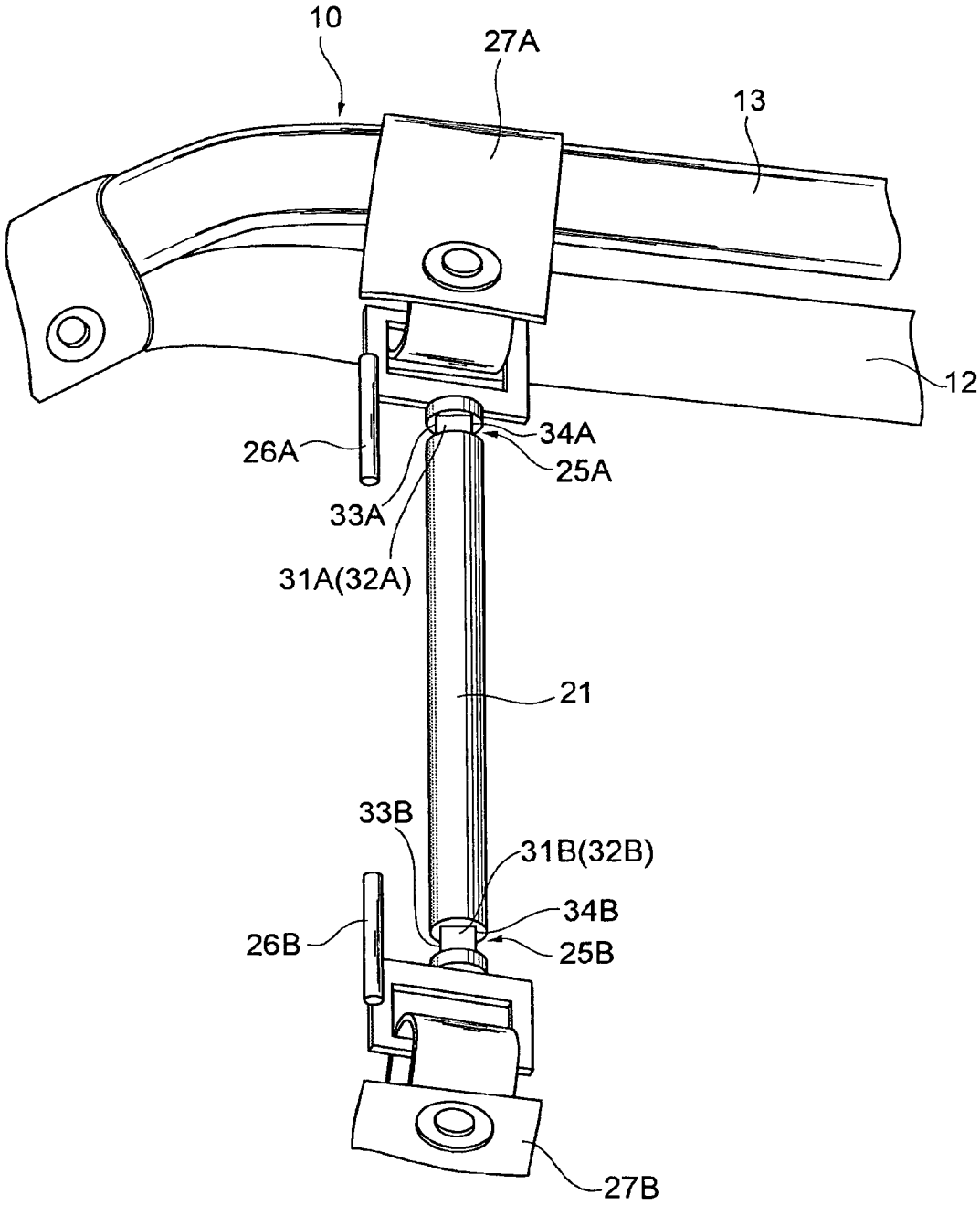
FIG. 5 is an enlarged view of part of the snowshoe with crampons shown in FIG. 4.
Figure 6:
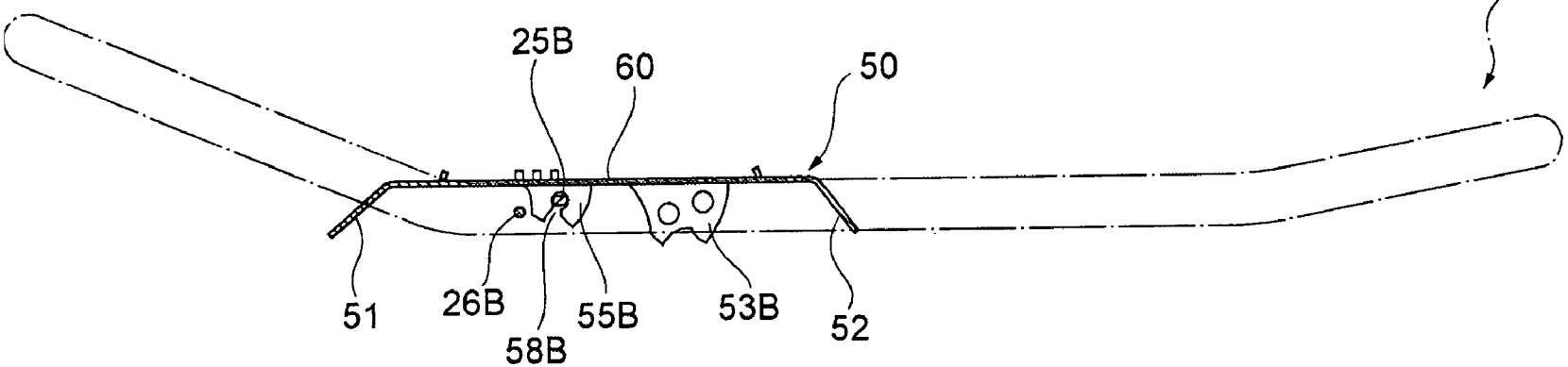
FIG. 6 is a schematic cross-sectional view showing the relationship between the snowshoe body and the attachable member as taken along line VI-VI in FIG. 2.
Figure 7:
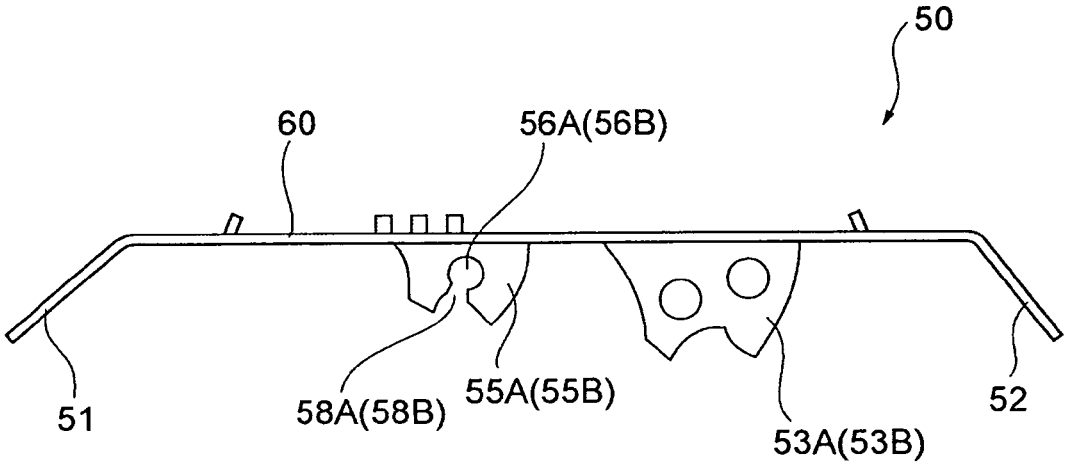
FIG. 7 is a side view of the attachable member from which straps are removed.
Figure 8:
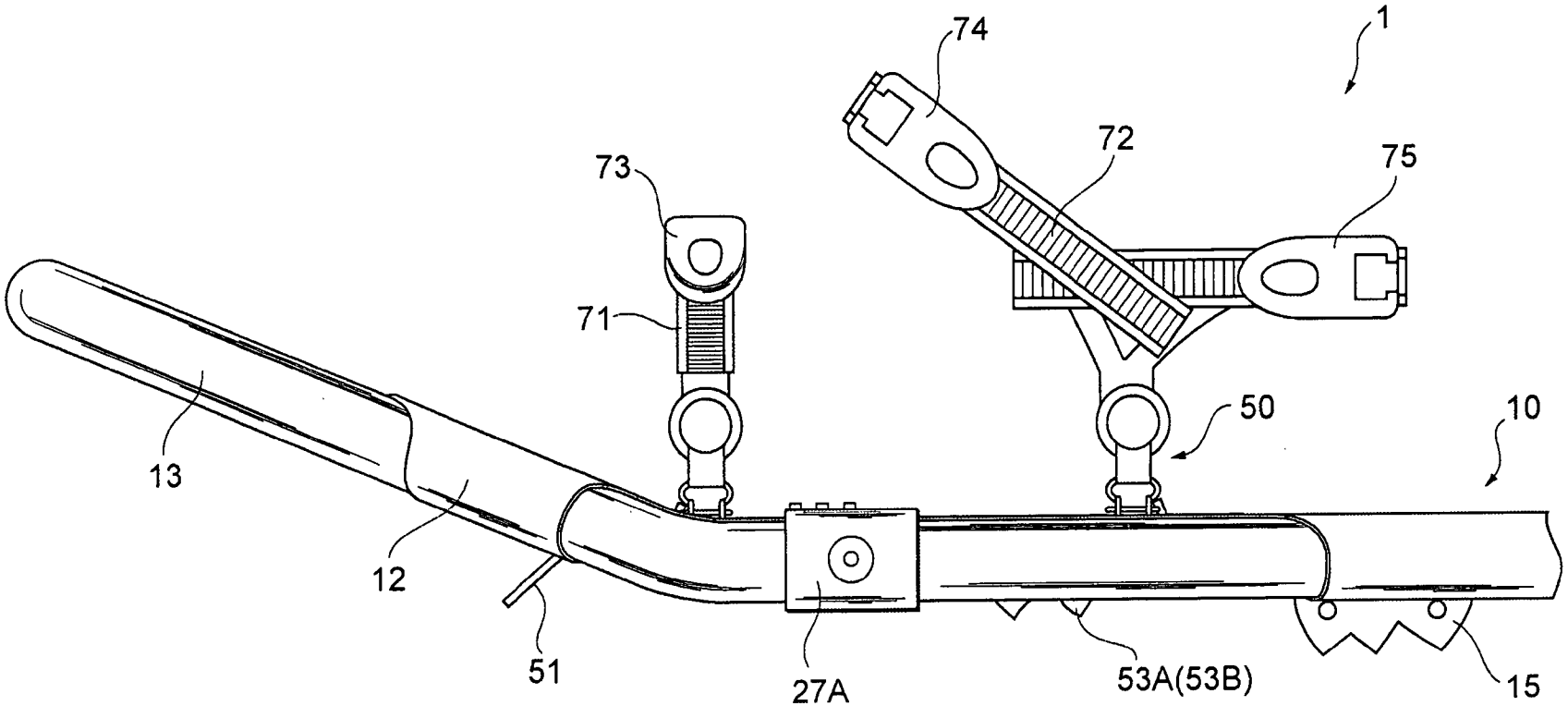
FIG. 8 is a side view of the snowshoe with crampons according to the embodiment of the invention.
Figure 9:
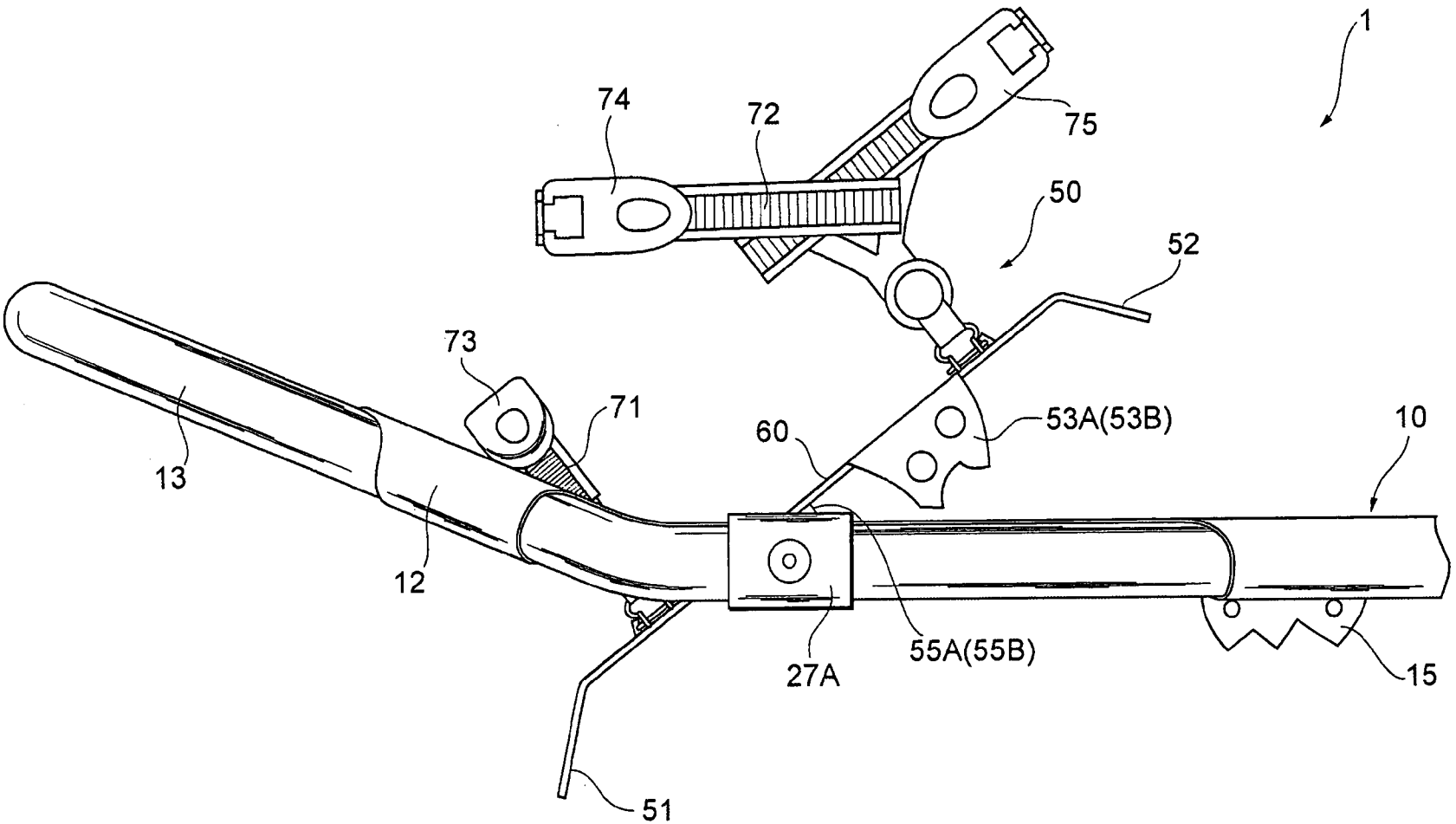
FIG. 9 is a side view of the snowshoe with crampons according to the embodiment of the invention and shows the state where the attachable member has been rotated a specified angle counterclockwise.
Figure 10:
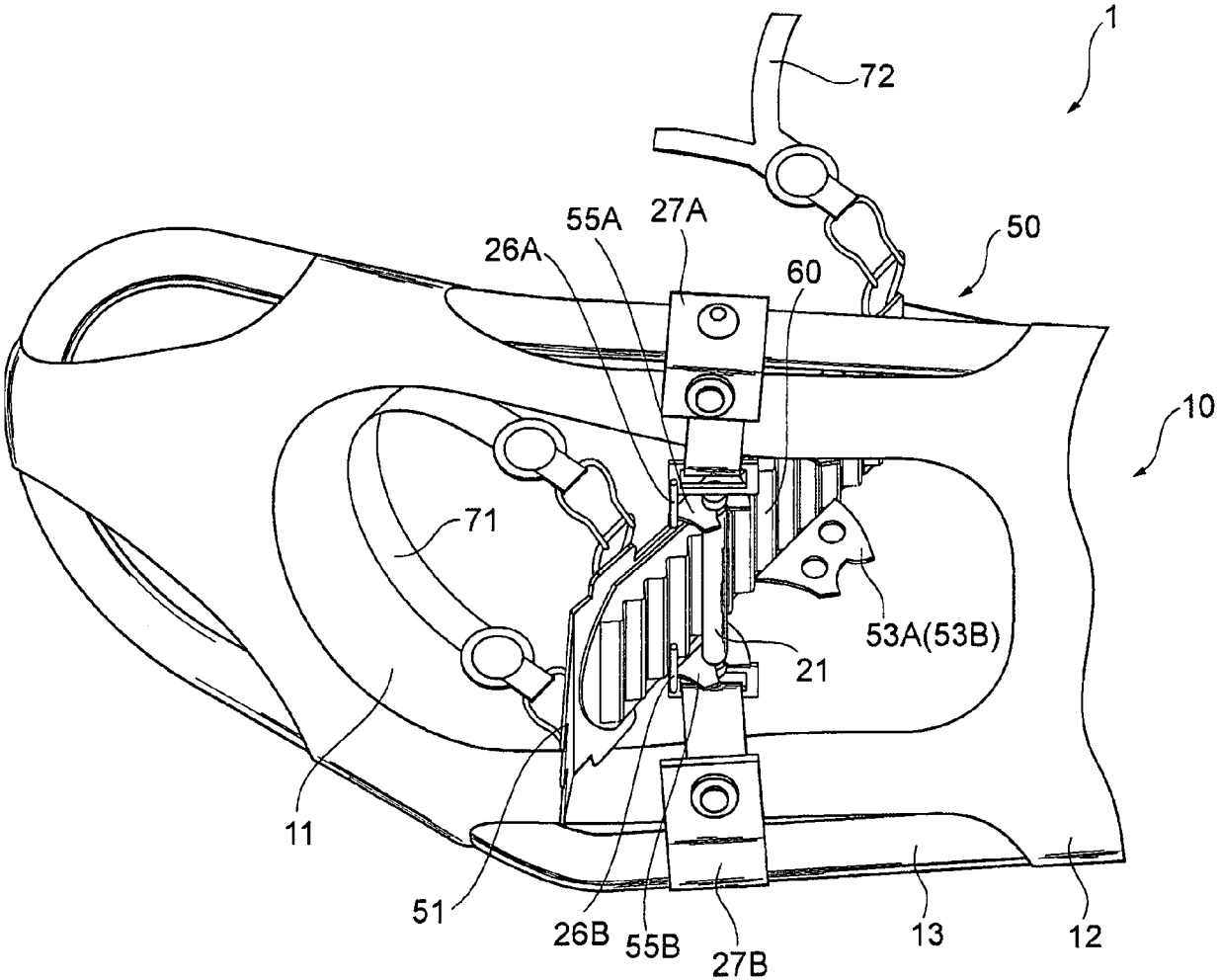
FIG. 10 is an enlarged perspective view of part of the snowshoe with crampons according to the embodiment of the invention as seen from obliquely below, and illustrates the state where the attachable member has been rotated a specified angle counterclockwise.
Figure 11:
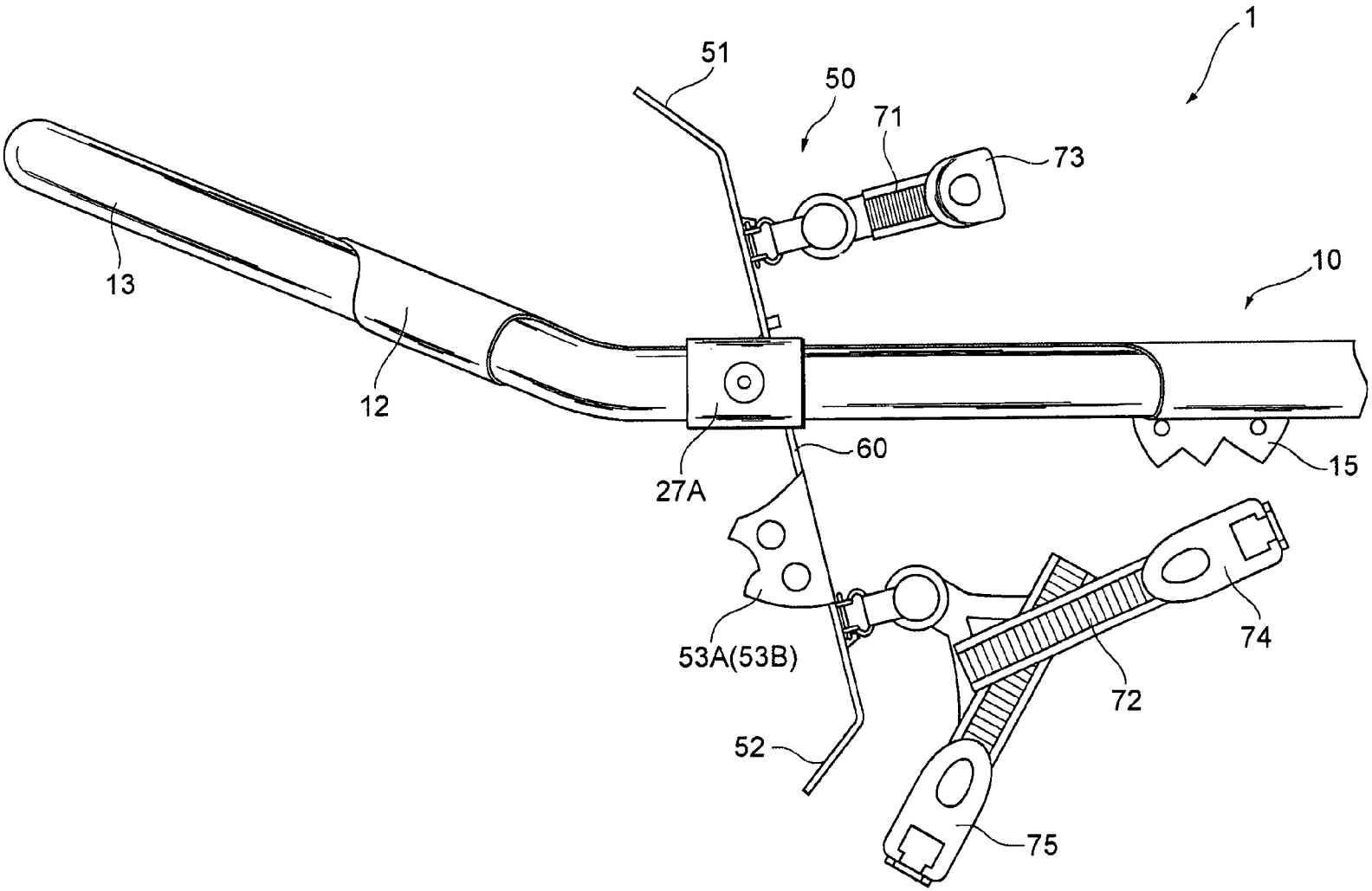
FIG. 11 is a side view of the snowshoe with crampons according to the embodiment of the invention and shows the state where the attachable member has been rotated a specified angle clockwise.
Figure 12:
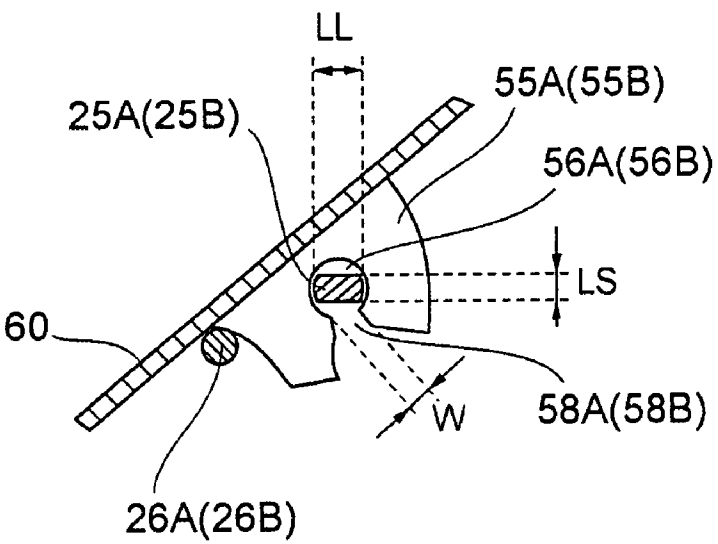
FIG. 12 shows schematic side views illustrating the relationship between first engaging members and second engaging members of the snowshoe with crampons according to the embodiment of the invention.
Figure 12:
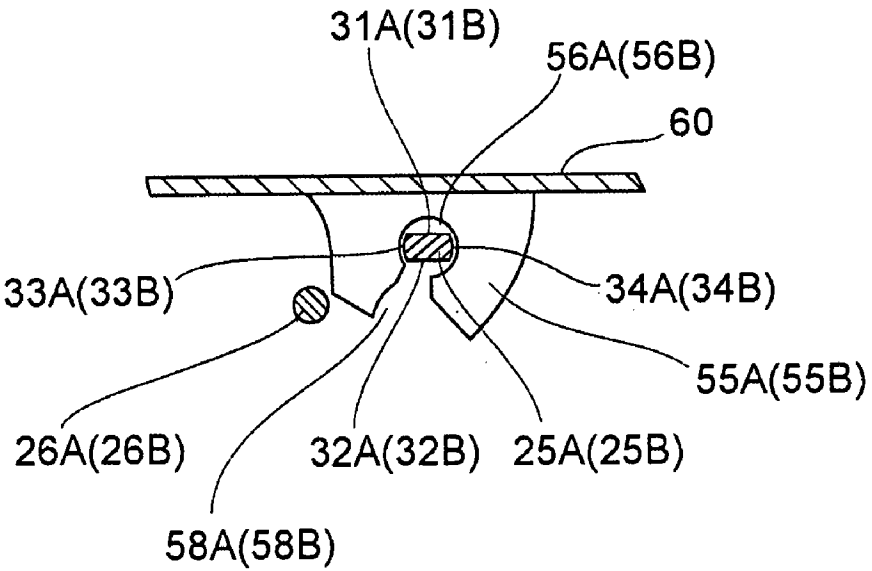
Figure 13:
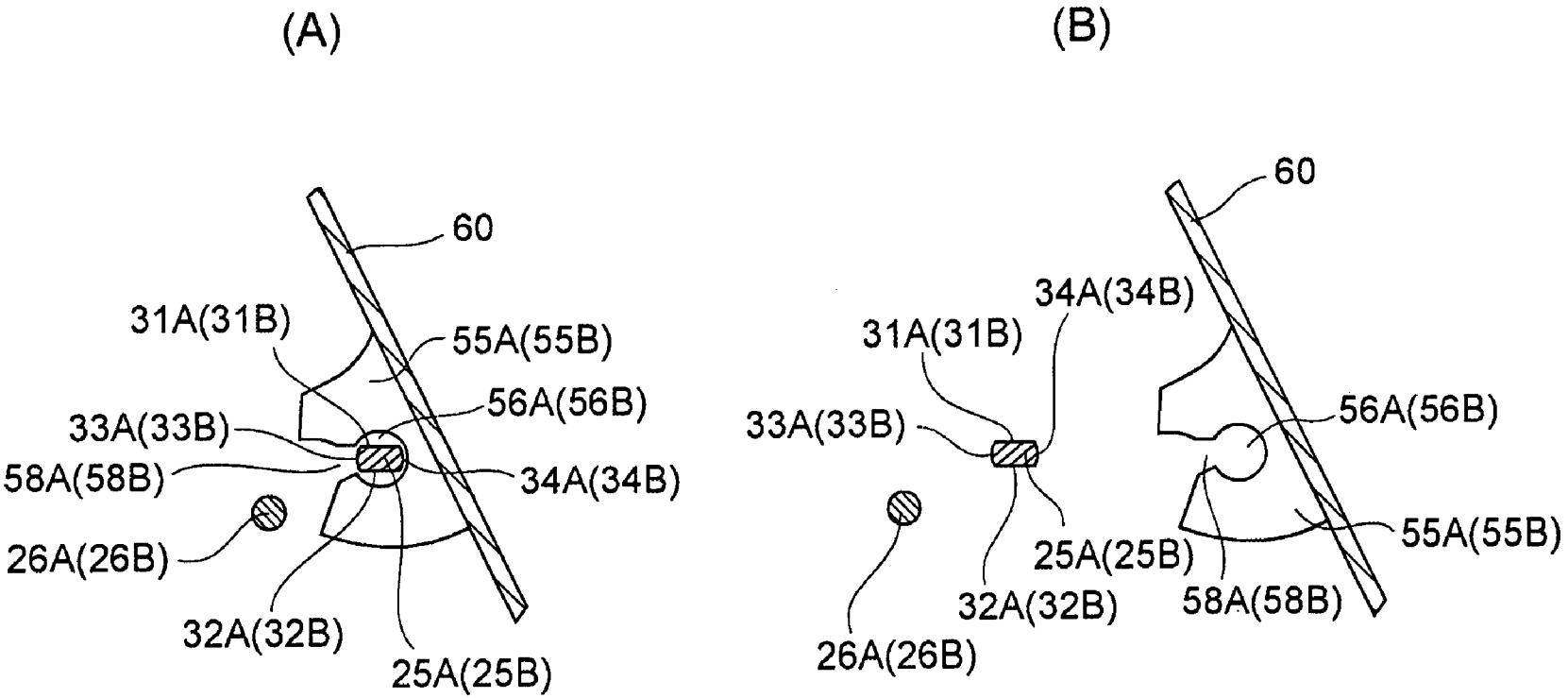
FIG. 13 shows schematic side views illustrating the relationship between the first engaging members and the second engaging members of the snowshoe with crampons according to the embodiment of the invention.
Figure 14:
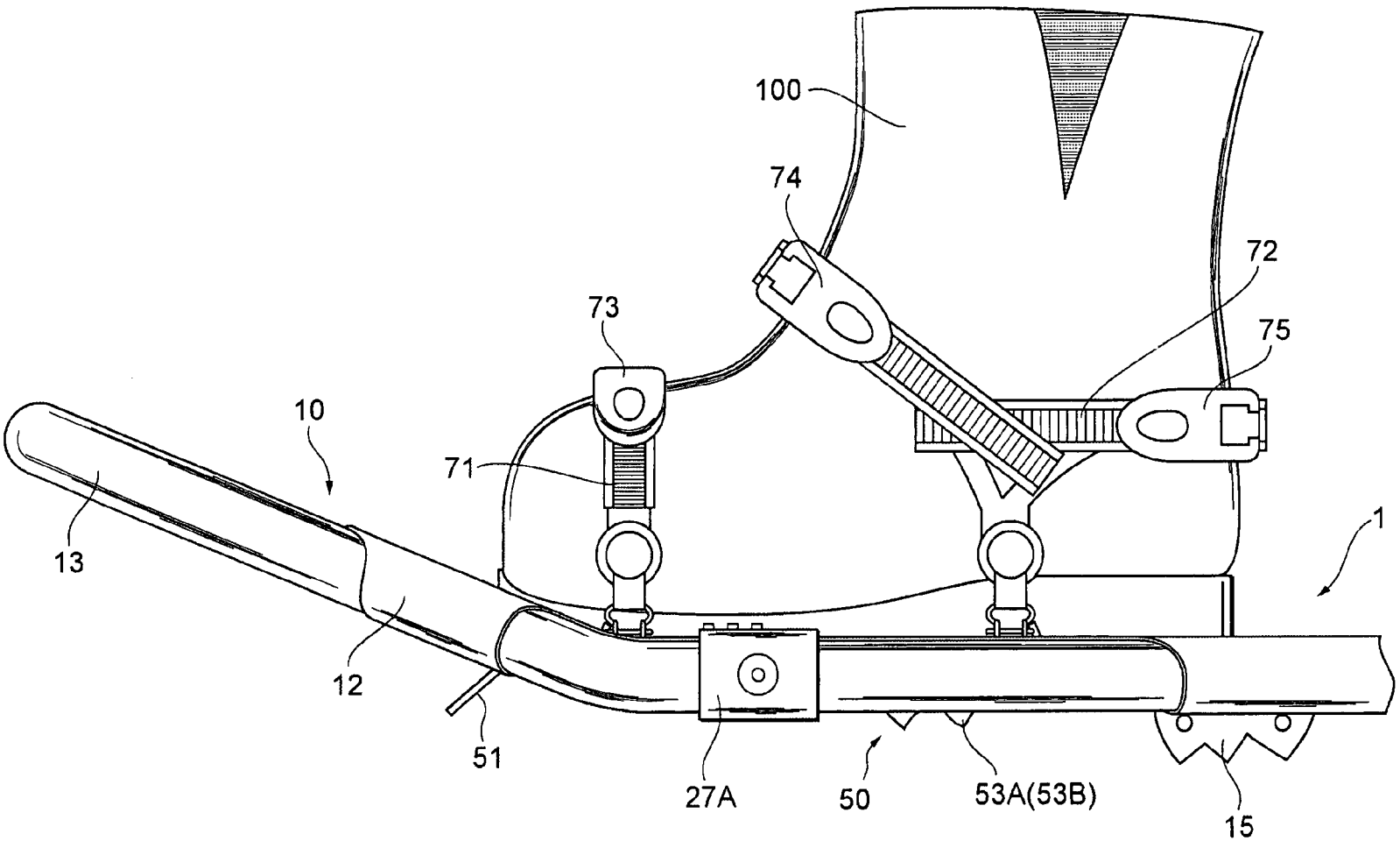
FIG. 14 is a side view of the snowshoe with crampons according to the embodiment of the invention in the state where a shoe is attached thereto.

FIG. 1 is a perspective view of a snowshoe with crampons according to an embodiment of the present invention. FIG. 2 is a plan view of the snowshoe with crampons according to the embodiment of this invention. FIG. 3 is a bottom view of the snowshoe with crampons according to the embodiment of this invention. FIG. 4 is a bottom view of the snowshoe with crampons according to the embodiment of this invention and shows the state where an attachable member is removed from a snowshoe body. FIG. 5 is an enlarged view of part of the snowshoe with crampons shown in FIG. 4. FIG. 6 is a schematic cross-sectional view showing the relationship between the snowshoe body and the attachable member as taken along line VI-VI in FIG. 2. FIG. 7 is a side view of the attachable member with the straps removed. FIG. 8 is a side view of the snowshoe with crampons according to the embodiment of the invention. FIG. 9 is a side view of the snowshoe with crampons according to the embodiment of the invention and shows the state where the attachable member has been rotated a specified angle counterclockwise. FIG. 10 is an enlarged perspective view of part of the snowshoe with crampons according to the embodiment of the invention as seen from obliquely below, and illustrates the state where the attachable member has been rotated a specified angle counterclockwise. FIG. 11 is a side view of the snowshoe with crampons according to the embodiment of the invention and shows the state where the attachable member has been rotated a specified angle clockwise. FIG. 12 shows schematic side views illustrating the relationship between first engaging members and second engaging members of the snowshoe with crampons according to the embodiment of the invention. FIG. 13 shows schematic side views illustrating the relationship between the first engaging members and the second engaging members of the snowshoe with crampons according to the embodiment of the invention. FIG. 14 is a side view of the snowshoe with crampons according to the embodiment of the invention in the state where a shoe is attached thereto.

For ease of comprehension, this embodiment will describe the thickness, size, enlargement and reduction ratios, and other details of each component without regard to with the actual thickness, size, enlargement and reduction ratios, and other details of the actual component. Also, in this embodiment, the direction to which the toe of footgear, when attached to the snowshoe with crampons, points is referred to as the "front"; the direction to which the heel of the footgear points is referred to as the "rear", the direction generally perpendicular to the longitudinal direction of the snowshoe is referred to as the "width direction"; the side of the snowshoe where the footgear is to be attached is referred to as the "upper side"; and the other side of the snowshoe, facing the ground is referred to as the "underside." Furthermore, "clockwise" and "counterclockwise" are described as the directions as seen with the toe side of the snowshoe with crampons on the left.

As shown in FIGS. 1 to 14, the snowshoe with crampons 1 according to this embodiment includes: a snowshoe body 10 whose upper side and underside are respectively of a size larger than that of the bottom of a shoe 100, which is footgear; and an attachable member 50 attached to the snowshoe body 10 so that the attachable member 50 can be detached from the snowshoe body 10 whenever necessary.

The snowshoe body 10 includes: a deck 12 having an opening 11 formed on the front side; and a frame 13 that is placed around the periphery of the deck 12 and constitutes the outside frame of the snowshoe body 10. The opening 11 formed in the deck 12 is open toward the front side beyond the position where the toe of the shoe 100 will be positioned when the shoe 100 is attached to the snowshoe with crampons 1. On the other hand, the rear edge of the opening 11 is positioned closer to the front side than the position where the heel portion of the shoe 100 will be placed when attaching the shoe 100 to the snowshoe with crampons 1. As a result, the heel portion of the shoe 100 will be mounted on the upper side of the deck 12. Also, a heel placement portion 14 on which the heel portion of the shoe will be mounted is provided in the rear area on the upper side of the deck 12. Furthermore, a heel crampon 15 that is a non-slip claw is placed in the rear area on the underside of the deck 12.

A generally-cylindrical spindle 21 that extends in the width direction across the opening 11 is placed at the frame 13. As specifically shown in FIG. 4, this spindle 21 is located in the generally middle position along the longitudinal direction of the opening 11 and supports the attachable member 50 so that the attachable member 50 can rotate around the spindle 21 as described later in detail. Second engaging members 25A and 25B for respectively engaging with first engaging members 55A and 55B formed on the attachable member 50 as described later in detail are formed at both ends of this spindle 21.

As specifically shown in FIGS. 6, 12, and 13, the cross-section of each second engaging member 25A, 25B as taken generally perpendicular to its axial direction is of a generally-oval shape. Specifically speaking, both side portions positioned generally perpendicular to the minor axis (or short axis) of the generally-oval shape are flat surfaces 31A (31B) and 32A (32B), and faces positioned on both sides of the major axis (or long axis) (the faces connecting the flat surfaces 31A (31B) and 32A (32B)) are curved surfaces 33A (33B) and 34A (34B). As shown in FIG. 12(A), the length LS of the minor axis (i.e., the distance between the flat surface 31A (31B) and the flat surface 32A (32B)) is designed to be shorter than the minimum length value W between side walls defining a cut 58A (58B) formed in the first engaging member 55A (55B) as described later in detail (see FIG. 12(A)); and the length LL of the major axis (i.e., the distance between the vertex of the curved surface 33A (33B) and the vertex of the curved surface 34A (34B)) is designed to be longer than the minimum value W.

On the front side of the position where the spindle 21 of the frame 13 is placed, stoppers 26A and 265 for preventing the attachable member 50 from rotating counterclockwise (as seen with the toe side on the left) more than a specified angle described later in detail are provided respectively.

In this embodiment, the spindle 21 and the stoppers 26A and 26B are integrally formed and are fixed to the frame 13 with fastening belts 27A and 27B. These fastening belts 27A and 27B are also fixed to the deck 12.

The attachable member 50 includes a base plate 60 whose upper side and underside are respectively of a size that can be placed within the opening 11. A first front crampon 51 protruding in a direction generally toward the ground is formed at the front end of the underside of the base plate 60, and a second front crampon 62 protruding in a direction generally toward the ground is formed at the rear end of the underside of the base plate 60. Also, third front crampons 53A and 53B are formed at both side edges (relative to the width direction) of the underside of the base plate 60 in its rear-end area.

The first engaging members 55A and 55B are formed on the underside the base plate 60 on both sides (relative to the width direction) of an area between the first front crampon 51 and the third front crampons 53A and 53B. These first engaging members 55A and 55B are placed with their top ends protruding in a direction generally toward the ground and, therefore, their top ends are shaped to serve as crampons. In a generally central area of the first engaging member 55A (55B), a support hole 56A (56B) is made so that the second engaging member 25A (25B) of the spindle 21 can be inserted into the corresponding support hole 56A (56B). The cut 58A (58B) is connected to, and formed as a passage to, the support hole 56A (56B).

The cut 58A (58B) is formed so that the minimum value W between the side walls defining the cut 58A (58B) (see FIG. 12(A)) is longer than the aforementioned length LS of the minor axis of the second engaging member 25A (25B), and shorter than the length LL of the major axis (see FIG. 12(A)). As a result, as described later in detail, when the minor axis of the second engaging member 25A is positioned generally parallel with the side wall surface defining the cut 58A and the minor axis of the second engaging member 25B is positioned generally parallel with the side wall surface defining the cut 58B, the second engaging members 25A and 25B will be respectively inserted into the corresponding support holes 56A and 56B of the first engaging members 55A and 55B through the cuts 58A and 58B, or will be taken out of the corresponding support holes 56A and 56B through the cuts 58A and 58B (see FIGS. 13(A) and 13(B)).

The cut 58A (58B) is made at such a position that when the attachable member 50 is rotated clockwise (as seen with the toe side on the left) a specified angle, the minor axis of the second engaging member 25A (25B) will be positioned in generally parallel with the side wall surface defining the cut 58A (58B) (see FIGS. 11 and 13(A)). Furthermore, the cut 58A (58B) is made at such a position that the minor axis of the second engaging member 25A (25B) will not be in generally parallel with the side wall surface defining the cut 58A (58B) when the attachable member 50 is rotated counterclockwise (as seen with the toe side on the left) until it comes into contact with the stopper 26A (26B). Therefore, when the attachable member 50 is rotated counterclockwise (as seen with the toe side on the left), the engagement between the first engaging member 55A (55B) and the second engaging member 25A (25B) will not be released (see FIGS. 9, 10, 12(A), and (B)).

A strap 71 for fastening the toe portion of the shoe 100 is attached to both sides (relative to the width direction) of the front area of the upper side of the base plate 60; and a strap 72 to be wound around the ankle portion of the shoe 100 for fastening the heel portion of the shoe 100 is attached to both sides (relative to the width direction) of the rear area of the upper side of the base plate 60. A length adjuster 73 is attached to the strap 71 and length adjusters 74 and 75 are attached to the strap 72 so that the length of the straps 71 and 72 can be adjusted in accordance with the size of the shoe 100.

Incidentally, when the attachable member 50 is removed from the snowshoe body 10, the attachable member 50 can be used independently as a climbing iron.

Next, the specific operation of the snowshoe with crampons 1 according to this embodiment will be described below with reference to the relevant drawings.

In order to attach the snowshoe with crampons 1 (in which the attachable member 50 is attached to the snowshoe body 10) to the shoe 100, the length adjusters 73 to 75 are first used to adjust the length of each strap 71 and 72, and the specified positions of the shoe 100 are fastened with the straps 71 and 72. If the person wearing the snowshoe with crampons 1 walks on snowy ground (sometimes including partly frozen surfaces), for example, in deep snow areas in winter mountains, the snowshoe with crampons 1 makes it easier for the wearer to walk on the snowy ground by distributing the wearer's weight over the snowy ground and obtain buoyancy over the snow, thereby reducing sinking into the snow.

While the wearer is walking, the first engaging member 55A (55B) rotatesso that the curved surfaces 33A and 34A (33B and 34B) of the second engaging member 25A (25B) come into contact with the inside wall defining the support hole 56A (56B) as shown in FIGS. 12(A) and (B). Consequently, if the wearers weight is put on the toe side of the shoe 100, the attachable member 50 rotates counterclockwise (as seen with the toe side on the left) around the spindle 21 as a fulcrum point as shown in FIGS. 9 and 10. If an attempt is made at that point in time to rotate the attachable member 50 more than the specified angle, the back side of the base plate 60 comes into contact with the stoppers 26A and 26B, thereby blocking any further rotation of the snowshoe body 10. As a result, the engagement between the first engaging members 55A and 55B and the second engaging members 25A and 25B will not be released, the attachable member 50 will not come off the snowshoe body 10, and the wearer can walk more safely and comfortably.

Also, since the heel portion of the shoe 100 is mounted on the deck 12 behind the rear side of the opening 11 as shown in FIG. 14, the wearer's weight to be put on the rear side will be borne mainly by the deck 12. Consequently, it is possible to prevent the attachable member 50 from rotating clockwise (as seen with the toe side on the left) more than necessary. As a result, while the wearer is walking, the attachable member 50, as shown in FIGS. 12(A) and 12(B), will not rotate further to the position where the minor axis of the second engaging member 25A (25B) becomes in generally parallel with the side wall surface defining the cut 58A (58B), and the attachable member 50 will not be removed from the snowshoe body 10.

When the wearer walks on frozen ground, the first front crampon 51, the second front crampon 52, the third front crampons 53A and 53B, the heel crampon 15, and the top ends of the first engaging members 55A and 55B serve to block slippage, and so the wearer can walk more safely and comfortably.

Next, in order to remove the attachable member 50 from the snowshoe body 10, the length adjusters 73 to 75 are first used to adjust the length of each strap 71 and 72, and the shoe 100 is then removed from the snowshoe with crampons 1. When the shoe 100 is removed from the snowshoe with crampons 1 as described above, the attachable member 50 can be arbitrarily rotated clockwise as seen with the toe side on the left. Subsequently, when the attachable member 50 has been rotated clockwise as seen with the toe side on the left as shown in FIG. 11, the first engaging member 55A (55B) is then positioned so that the minor axis of the second engaging member 25A (25B) is in generally parallel with the side wall surface defining the cut 58A (58B) as shown in FIG. 13(A), and then the second engaging member 25A (25B) is taken out of the support hole 56A (56B) through the cut 58A (58B) (see FIG. 13(B)). In this way, the attachable member 50 can be easily removed from the snowshoe body 10.

Since the straps 71 and 72 for fastening the shoe 100 are attached to the attachable member 50, if the attachable member 50 removed from the snowshoe body 10 is attached to the shoe 100, using the straps 71 and 72, the attachable member 50 can be used as a climbing iron.

In order to attach the attachable member 50 to the snowshoe body 10, it is only necessary to first place the side wall surface defining the cut 58A (58B) formed in the first engaging member 55A (55B) generally parallel with the minor axis of the second engaging member 25A (25B), and insert the second engaging member 25A (25B) into the cut 58A (58B) and then further to the support hole 56A (56B).

Incidentally, this embodiment describes the case where the spindle 21 with its both ends fixed to the frame 13 supports the attachable member 50 so that the attachable member 50 can rotate around the spindle 21. However, the type of spindle for supporting the attachable member 50 is not limited to this example, and any other kind of member, such as a cantilever spindle, may be used, as long as the attachable member 50 is placed in the snowshoe body 10 so that the attachable member 50 can be attached to or detached from the snowshoe body 10 whenever necessary; and as long as the engagement between the attachable member 50 and the snowshoe body 10 can be released and the attachable member 50 can be removed from the snowshoe body 10 when being rotated a specified angle.

Furthermore, this embodiment describes the case where the first engaging member 55A (55B) engages with the second engaging member 25A (25B) by inserting the second engaging member 25A (25B) through the cut 58A (58B) into the support hole 56A (56B); and the above engagement is released by pulling the second engaging member 25A (25B) through the cut 58A (58B) out of the support hole 56A (5B). However, the configuration for the engagement and the release thereof is not limited to this example, and other configurations may be applied as long as the snowshoe body 10 and the attachable member 50 can engage with each other and this engagement can be released by rotating the attachable member 50 a specified angle.

This embodiment also describes the case where the top ends of the first engaging member 55A (55B) serve as crampons. However, the functional feature of the first engaging member 55A (55B) is not limited to this example, and the first engaging member 55A (55B) does not necessarily serve as a crampon.

Furthermore, this embodiment describes the case where an attachable member 50 removed from the snowshoe body 10 can be used as a climbing iron by attaching the straps 71 and 72 to the attachable member 50. However, the configuration of the snowshoe with crampons 1 is not limited to this example, and the straps 71 and 72 may be attached to the snowshoe body 10 if desired.

This embodiment also describes the case where the straps 71 and 72 are placed as fastening members for fastening the shoe 100 to the snowshoe with crampons 1. However, it is a matter of course that the type of the fastening members is not limited to the above example, and a fastening member of any other shape can be used, as long as it can fasten the shoe 100 to the snowshoe with crampons 1.

What is claimed is:

1. A snowshoe with crampons for preventing footgear from sinking into snow, the snowshoe with crampons comprising:

a snowshoe body having a larger area than that of the bottom of the footgear and including an opening located in a toe-side area of the footgear when the footgear is attached to the snowshoe with crampons; and an attachable member located in the opening in the snowshoe body and placed in the snowshoe body so that it can be attached to or detached from the snowshoe body whenever necessary;

wherein the attachable member has, on its surface opposite the other surface to which the footgear is to be attached, crampons protruding in directions generally toward the ground and first engaging members for engaging with the snowshoe body in such a manner that they can rotate and be attached or detached from the snowshoe body; and when the attachable member has been rotated a specified angle, the first engaging members release the engagement with the snowshoe body and release the attachable member from the snowshoe body.

2. The snowshoe with crampons according to claim 1, wherein the snowshoe body has a spindle extending in a generally-horizontal direction relative to a widthwise direction of the snowshoe body and being placed across the opening and supports the attachable member so that the attachable member can rotate around the spindle; and the spindle includes second engaging members for engaging with the first engaging members so that the first engaging members can rotate around the second engaging members and be attached to or detached from the second engaging members.

3. The snowshoe with crampons according to claim 2, wherein the snowshoe body has a stopper for preventing the attachable member from rotating more than the specified angle counterclockwise as seen with the toe side of the snowshoe body on the left.

4. The snowshoe with crampons according to claim 2, wherein when the attachable member has been rotated a specified angle clockwise as seen with the toe side of the snowshoe body on the left, the engagement between the first engaging members and the second engaging members can be released.

5. The snowshoe with crampons according to claim 4, wherein each of the first engaging members has a support hole for supporting the spindle so that it can rotate, and a cut formed as a passage to the support hole; and each of the second engaging members is of a generally-oval cross-sectional shape as taken generally perpendicular to its axial direction, and a minor axis of the generally-oval shape is shorter than a minimum value of the distance between the second engaging member and a side wall of the first engaging member defining the cut; and wherein when the attachable member has been rotated a specified angle clockwise as seen with the toe side of the snowshoe body on the left, the minor axis of the generally-oval shape is positioned in generally parallel with the side wall surface defining the cut, and each of the second engaging members is removed through the cut from the support hole, thereby releasing the engagement.

6. The snowshoe with crampons according to claim 1, wherein a fastening member for fastening the footgear to the snowshoe with crampons is placed on one surface of the attachable member where the footgear is to be attached.

7. The snowshoe with crampons according to claim 1, wherein the first engaging members are formed as crampons protruding in directions generally toward the ground from one surface of the attachable member opposite the other surface where the footgear is to be attached.

* * * * *